United States Patent [19]

Rodth

[11] 4,008,832

[45] Feb. 22, 1977

[54] THREE DRINK GRAVITY DISPENSER FOR COOL BEVERAGES

[75] Inventor: Joseph John Rodth, Barkhemstead, Conn.

[73] Assignee: The Coca-Cola Co., Atlanta, Ga.

[22] Filed: Oct. 28, 1975

[21] Appl. No.: 626,400

[52] U.S. Cl. ..... 222/129.1; 62/138; 62/399; 222/146 C

[51] Int. Cl.² ..... B67D 5/56

[58] Field of Search ..... 222/146 C, 129.4, 129.3, 222/129.1; 62/138, 189, 308, 399, 353; 165/164

[56] References Cited

UNITED STATES PATENTS

| | | | |
|---|---|---|---|
| 2,462,019 | 2/1949 | Bowman | 222/129.4 X |
| 2,502,603 | 4/1950 | Tanner | 222/129.4 X |
| 2,750,076 | 6/1956 | Welty et al. | 222/146 C X |
| 3,215,312 | 11/1965 | Guzzi | 222/129.4 |
| 3,367,127 | 2/1968 | Walker | 62/353 X |

*Primary Examiner*—Stanley H. Tollberg
*Assistant Examiner*—Hadd Lane
*Attorney, Agent, or Firm*—W. Dexter Brooks

[57] ABSTRACT

An apparatus for dispensing one or more post-mix beverages is described. A gravity type dispenser having a plurality of valves which alternatively dispense syrup or concentrate with either carbonated or sweet water. The carbonated and sweet water are supplied from a carbonating and cooling assembly. Cooling of the sweet water is performed by passing the sweet water through a coil emersed in the carbonated water tank. The rate of carbonation of the water is assisted by a rotary agitator which is intermittently energized in synchronism with the beginning of the dispensing operation. The syrup storage tanks and carbonating assembly are in thermal contact to facilitate cooling of the syrup in the dispenser. Additional automatic controls are provided for maintaining the water level and ice bank thickness, and thus, the temperature of the carbonated water in the carbonating assembly within predetermined limits. The temperature of the fluid inlet and outlet fittings to the carbonating assembly are maintained above freezing by the use of heating elements which are positioned in contact with each of the fittings.

14 Claims, 3 Drawing Figures

THREE DRINK GRAVITY DISPENSER FOR COOL BEVERAGES

BACKGROUND OF THE INVENTION

1. Field of the Invention

The present invention relates to a post-mix dispensing apparatus for dispensing one or more carbonated or non-carbonated beverages. More specifically, the present invention relates to a post-mix dispensing apparatus wherein the constituents of the post-mix are chilled prior to dispensing.

2. Description of Prior Art

Heretofore, ice bath post-mix dipensers have been known in the art but in each instance have suffered from certain drawbacks and disadvantages.

For example, known forms of these dispensers encounter freeze-up problems both in the carbonating assembly and the fluid conduits coupled thereto.

In addition, in order to chill the sweet water and syrup, separate cooling circuits or containers are provided in these known prior art devices. Many of these known devices depends upon two stage heat transfer, (i.e., refrigeration to bath and bath to produce). This substantially increases the size of the dispensers and the power operating requirements.

Moreover, known ice bath post-mix dispensers include problems, such as poor sanitation, loss of efficiency, bulky size and extreme complexity.

Many prior art devices have further been lacking in adequate ice bank thickness, and thus, temperature controls for the carbonator and cooling assembly. This lack of control has resulted in the dispensing of beverages outside of a desirable temperature range.

SUMMARY OF INVENTION

Accordingly, it is a primary object of the present invention to provide a post-mix beverage dispensing apparatus which substantially reduces the chances of system freeze-ups.

It is another object of the present invention to provide a beverage dispensing apparatus which chills the carbonated water without need for an additional cooling stage.

It is a further object of the present invention to provide a dispensing apparatus with a highly sanitized ice bath arrangement within a carbonating and cooling assembly.

It is still another object of the present invention to provide a dispensing apparatus which facilitates the pre-chilling of the syrup or concentrate.

It is a further object of the present invention to provide a beverage dispensing apparatus which accurately controls the ice bank thickness, and thus, the temperature of the carbonating and cooling assembly within predetermined limits to help preclude freeze-ups in the assembly.

It is still a further object of the present invention to provide an electronic controller means for automating the operation of the components of the beverage dispensing system.

The objects of the present invention are fulfilled by providing a gravity dispenser assembly, a carbonating and cooling assembly, and an electronic controller for coordinating the operation of the dispensing, carbonating, and cooling assemblies.

The dispensing assembly may include a plurality of storage tanks for storing syrup or concentrate to be dispensed and dispensing valves. The dispensing valves communicate by suitable conduits to both the syrup storage tanks and the carbonating and cooling assembly. The carbonating and cooling assembly supplies both carbonated and sweet pre-chilled water to the dispensing valves, where it is mixed with selected syrups or concentrates. Means are provided in the dispensing system for sensing the commencement of a dispensing step to intermittently operate the agitator of the carbonator assembly. This intermittent operation, as discovered by the present invention, helps preclude freeze-ups in the carbonator tank.

The carbonator and cooling assembly includes a unique rotary agitator arrangement for mixing carbon dioxide gas and water to facilitate the carbonation thereof. As stated hereinbefore the agitator is operated only intermittently in synchronism with the commencement of a dispensing cycle. The carbonator is surrounded by a cooling coil in order to form an ice bank on the interior wall of the carbonator and cooling assembly supplied with fluid from a refrigeration unit in order to pre-chill the carbonated water to be dispensed.

The carbonator and cooling assembly is particularly unique in that the conduit for supplying sweet water to the dispensing valves passes directly through the carbonated water in the carbonator.

The syrup storage tanks and carbonator-cooler assembly of the present invention are juxtaposed in a heat exchanging relationship. Therefore, the syrup or concentrate is also pre-chilled by the cooling means of the carbonator.

Heater means are provided at all fluid inlet and outlet couplings to the carbonator cooler, which precludes freeze-ups at said couplings.

An electronic controller is provided for turning the aforementioned agitator on in response to the commencement of a dispensing cycle and for continuing operation of the agitator for a predetermined period of time after dispensing ceases. The electronic controller further includes means for automatically controlling the carbonated water level and ice bank thickness in the carbonator, and means for heating the aforementioned inlet and outlet couplings thereto.

The electronic control means of the present invention may consist of any well known control components without departing from the spirit and scope of the present invention. For example, the controller may contain solid state or electromagnetic switching relays which change state in response to the receipt of control signals and generate command outputs in response thereto. The time delay function of the controller may be provided by any known type of solid state RC timer or electromagnetic time delay relays that would occur to the artisan.

BRIEF DESCRIPTION OF DRAWINGS

The objects of the present invention and the attendant advantages thereof will become more fully understood by reference to the following description of the drawings wherein.

DETAILED DESCRIPTION OF PREFERRED EMBODIMENTS

Figure 1A:
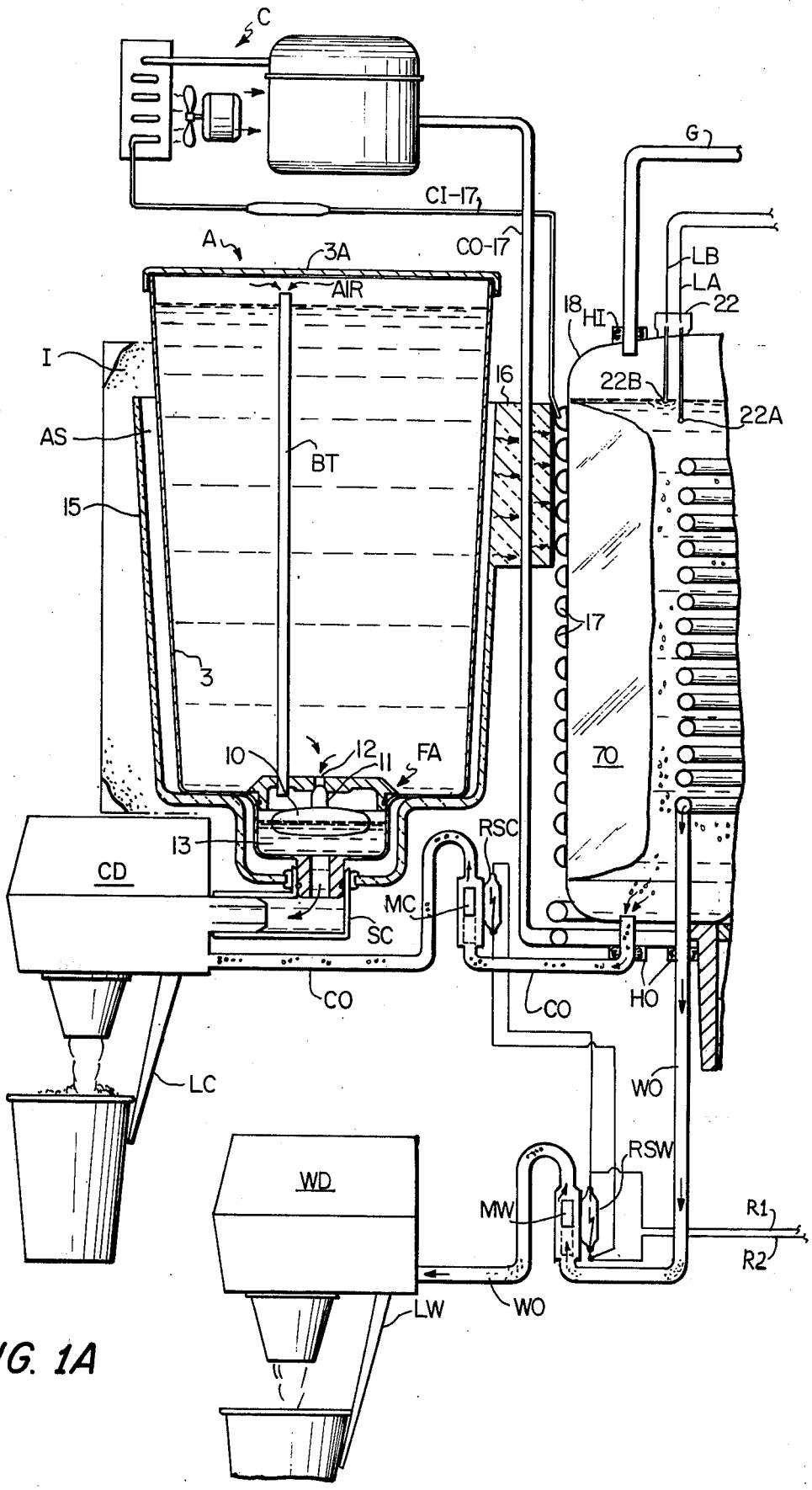
FIG. 1A is an elevational view illustrating the syrup dispensing system of the present invention.

Referring in detail to FIG. 1A there is illustrated the syrup dispensing system of the present invention generally designated A.

There is provided in system A a plastic reservoir tank 3 for storing a syrup supply to be dispensed and mixed with either carbonated water in carbonated water dispensing valve CD or sweet water in sweet water dispensing valve WD. Only one tank 3 and associated elements are shown for illustrative purposes. However, it should be understood that a separate syrup tank is provided for dispensing valve WD and any other additional dispensing and mixing means which may be included in the system. All such tanks are coupled to the respective dispensing valves, as illustrated in FIG. 1A with respect to dispenser valve CD.

Syrup tank 3 is provided at the top thereof with a removable cover 3A to facilitate filling of tank 3 with syrup of a chosen flavor. The syrup is filled to a level just below the top of breather tube BT to provide an air space between cover 3A and the top of the syrup.

The bottom of tank 3 rests in direct contact with the bottom of a tapered aluminum well 15 which substantially encloses tank 3. Well 15 is so dimensioned that an air space AS exists between the side walls of tank 3 and well 15. This air space AS functions to insulate tank 3 from the surrounding atmosphere.

The side walls of well 15 are thicker at the bottom to facilitate cooling of the concentrate (syrup) but to prevent freezing. In other words the concentrate is gradually cooled as it passes from top to bottom of the tank 3.

Well 15 includes another thickened portion or pad 16 which extends outwardly into contact with refrigeration coil 17 of the carbonator 30 of FIG. 1B to be described more fully hereinafter. Outlet conduit CO-17 for refrigeration coil 17 extends directly through thickened portion or pad 16 from coil 17 back to refrigeration compressor C, the function of which will become more readily apparent hereinafter with reference to FIG. 1B. The thickened portion or pad 16 of aluminum well 15 thus functions as a heat transfer coupling between coil 17 and syrup tank 3. Accordingly, the syrup in tank 3 becomes slightly chilled due to the transfer of heat through thickened portion 16. To improve the efficiency of the coupling a heat conducting paste can be provided between pad 16 and coil 17.

To further insulate tank 3 and thermally couple the same to carbonator 30 a foam jacket I is provided, which completely surrounds both the syrup tank 3 and the carbonator 30.

Tank 3 is further provided at the bottom thereof with a well portion which defines a reservoir 13. Disposed within reservoir 13 is a float assembly FA which includes an annular seal with a central aperture 12 therein and a float 10 having a seal portion 11 which becomes seated in aperture 12 between dispensing steps. During dispensing, as will be described hereinafter, syrup is free to flow through aperture 12 and conduit SC into a dispensing valve such as CD where it is mixed with chilled carbonated water entering through conduit CO.

Each of the dispensing valves such as CD and WD are provided with actuating levers LC and LW, respectively. As illustrated, levers LC and LW can be actuated by pressing a cup to be filled against the same. In response to the actuation of these levers, valves CD and WD are opened permitting the flow of flavor concentrate (syrup) and carbonated or sweet water into the drinking cups in predetermined proportions.

It should be understood that dispensing valves of the type described are well known in the art and any suitable type may be utilized in the system described herein without departing from the spirit and scope of the present invention.

Referring briefly to the operation of the dispensing system A of the present invention, dispensing commences with the actuation of a lever such as LC which opens valve CD thus withdrawing the liquid in reservior 13. Float 10 then drops which opens aperture 12 and permits the flavor concentrate to flow as long as lever LC is actuated. When lever LC is no longer actuated valve CD closes, the level of concentrate rises in reservoir 13, and seal 11 of float 10 closes aperture 12.

The flow of carbonated water through conduit CO or sweet water through conduit WO is sensed when dispensing begins by reed switch assemblies RSC and RSW, respectively. As illustrated permanent magnets MC nad MW are provided in enlarged portions of conduits CO and WO. In a static no flow condition each magnet is disposed in the bottom of said enlarged conduit portions out of proximity of the contacts of reed switches RSC, RSW. However, as fluid begins to flow in response to the commencement of a dispensing step, the respective magnets MC, MW move to the positions shown thus closing reed switches RSC, RSW. The closing of the reed switches supplies signals through lines R1, R2 to electronic controller EC for purposes to be described more fully hereinafter.

Figures 1B, 2:
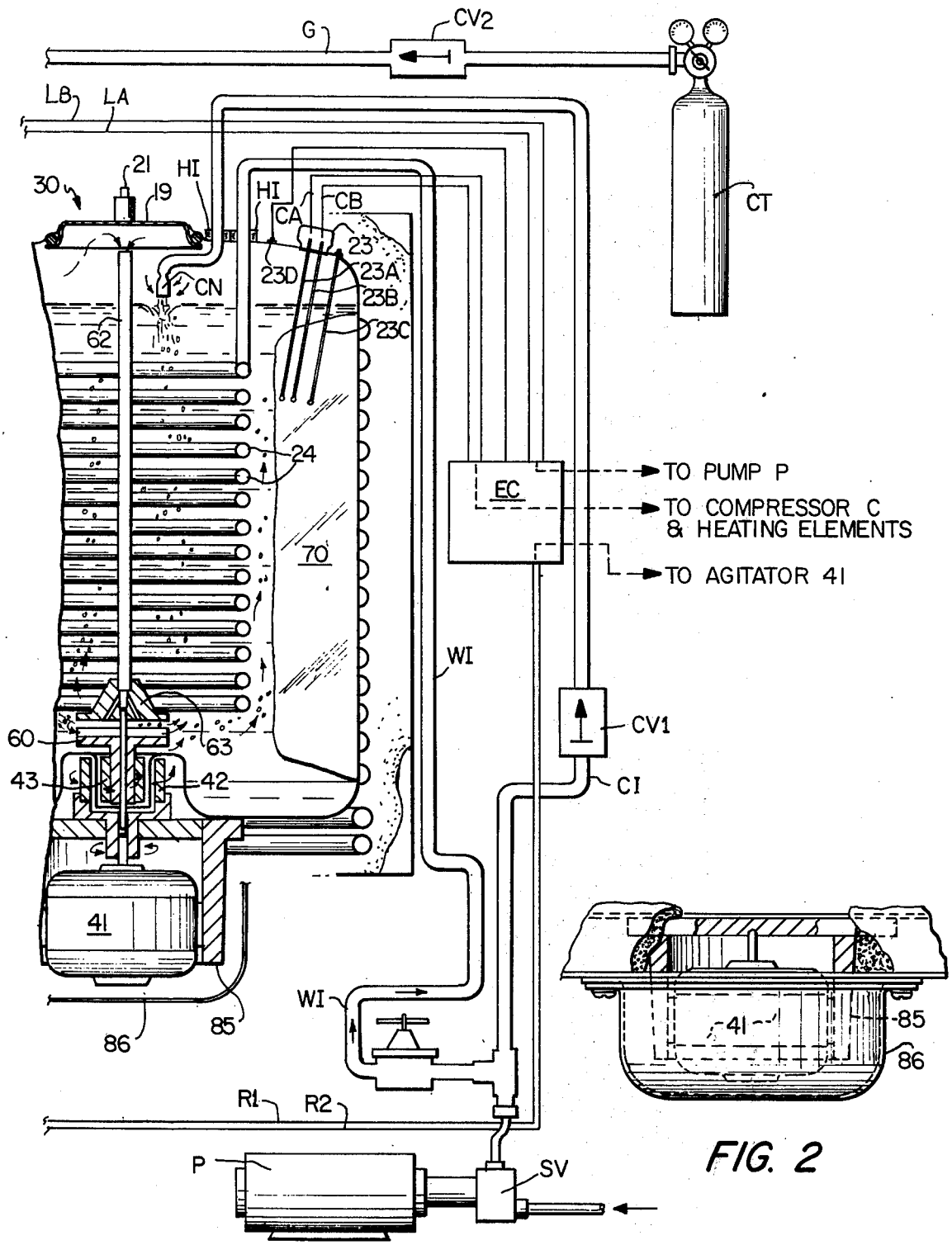
FIG. 1B is an elevational view of the carbonating and cooling unit of the present invention for use with the syrup dispenser of FIG. 1A.
FIG. 2 is an enlarged sectional view illustrating the details of the carbonating agitator of FIG. 1B.

Referring in detail to FIG. 1B there is illustrated a carbonating and cooling unit generally designated 30 which is suitably coupled to fluid inlet and outlet conduits and an electronic controller EC.

Carbonating and cooling unit 30 inlcudes a stainless steel tank 18 having an access cover 19 thereon. Disposed within cover 19 is an automatic pressure relief valve 21. A cooling coil 17 is coiled around the outer side walls of tank 18. Cooling fluid is supplied to coil 17 from refrigeration compressor assembly C of FIG. 1A via inlet conduit CI-17. The cooling fluid returns to compressor C via conduit CO-17. As a result of refrigerated fluid flowing through coil 17 an ice bank 70 forms around the side walls of cylindrical tank 18. Thus, any liquid passing through tank 18 becomes chilled, which is a primary object of the dispensing system of the present invention.

Disposed within the bottom of tank 18 is an agitator assembly including an electric drive motor. Motor 41 has an output shaft rigidly affixed to an outer magnetic concentric 42 which is magnetically coupled to an inner magnetic concentric 42 affixed to agitator impeller 60. Thus, rotation of impeller 60 results from the energization of motor 41.

The agitator impeller 60 functions in a conventional manner to mix carbon dioxide gas in tank 18 with sweet water to form carbonated water. Carbon dioxide gas from tank CT enters tank 18 at the top thereof through check valve CV2 in conduit G and proceeds through centrally disposed gas supply tube 62 to dispenser plate 63. Impeller 60 is disposed adjacent dispenser plate 63 and therefore swirls the gas exiting therefrom. Thus, the carbon dioxide gas is mixed with the water in tank 18 to form carbonated water.

Also disposed within tank 18 is a sweet water supply coil 24. Sweet water is supplied to coil 24 through the top of tank 18 via conduit WI. Sweet water is supplied to conduit WI through a bypass in pump SV. Sweet water passes through conduit 24 and exists at the bottom of tank 18 through outlet conduit WO (FIG. 1A). As can be readily seen, the water passing through coil 24 will become chilled by surrounding coil 17 and ice bank 70.

Also connected to water pump SV is inlet conduit CI for supplying water to be carbonated to tank 18. This water enters tank 18 through venturi nozzle CN disposed in the upper portion of the tank. carbonation is initiated when the water emerges from venturi nozzle, as described hereinbefore, and is further processed by the suction action of impeller 60. Impeller 60 draws the carbonating gass into and down through gas supply tube 62 to dispenser plate 63, whereupon the impeller swirls the carbonating gas exiting from gas supply tube 62 and the carbon dioxide gas is mixed with the water in tank 18 to form carbonated water. This carbonated water then passes out of the bottom of tank 18 through outlet conduit CO, if desired inlet conduit CI may include a check valve CV1.

It has been found especially effective in the present invention to provide all inlet and outlet water or gas couplings to tank 18 with heater means in order to preclude freeze-ups. All inlet heaters are designated HI and outlet heaters HO. Heaters HI, HO may be any suitable resistance or induction type heaters and are coupled to electronic controller EC to be described hereinafter. In a preferred embodiment the heaters are turned on simultaneously with compressor assembly C by signals generated by electronic controller EC.

Also disposed within tank 18 are conductive probes for sensing water in tank 18. A first set of probes 22A, 22B are provided for sensing the water level in tank 18. A second set of probes 23A, 23B, 23C are provided for sensing the condition of ice bank 70. Each of the probes generates signals which are fed to electronic controller EC to perform functions to be described hereinafter.

Referring in detail to the function of probes 22A, 22B it can readily be observed that the ends thereof are vertically spaced a predetermined distance within tank 18. The respective probes 22A, 22B are connected to electronic controlled EC through electrical lines LA, LB. Lines LA, LB pass into tank 18 through an electrically insulated fitting 22. In operation when water drops below the end of probe 22A a signal passes along line LA to controller EC. Controller EC by means of an electronic relay then generates a signal to pump SV which supplies more water to tank 18 through conduit CI and nozzle CN. When water rises to the level of probe 22B, a signal is generated through line LB to controller EC. Controller EC by means of said electronic relay then cuts pump SV OFF in response thereto. Thus, probes 22A, 22B in combination with controller EC automatically control the water level in tank 18.

Referring in detail to the function of probes 23A, 23B, 23C it can be observed in FIG. 1B that the ends of these probes are spaced at predetermined distances transversely of ice bank 70. Probes 23A, 23B are coupled through insulating fitting 23 in the top of tank 18 to electrical connectors CA, CB, respectively. Connectors CA, CB extend to electronic controller EC. One end of probe 23C is welded to tank 18 to maintain ground to the tank wall. Also provided is an electrical ground connection 23D which is connected to ground of the electronic controller circuit EC.

The probes 23A and 23B form a three element sensing system with ground contact 23D. The three element system senses the condition of ice bank 70 and turns compressor C ON or OFF via controller EC to control the condition of the ice in tank 18.

For example, compressor C is turned ON via controller EC when there is water between outer probe 23B and ground contact 23D, i.e., either ice melts to expose the top of probe 23B or ice melts away from the wall of tank 18 (ground). When ice melts away from the wall, the ice becomes an island within the tank. Thus, there is water between the probe 23B and the grounded tank wall. This can occur even while the probe 23B is firmly buried in the ice 70.

The compressor shuts OFF only when probe 23A is completely buried in ice. At this point the ice is also firmly frozen to the tank walls (ground) and so the circuit is opened between probes 23A and 23C due to the effect of the higher impedance of the water when in a frozen state. In contrast, when the ice melts away from the wall, there is water between the probe 23B and the grounded tank wall and the circuit is closed due to the lower impedance of the water when in a melted state.

Probe 23C is needed to maintain ground contact in the ice near probes 23A, 23B, so that if ice melts away from the walls, the control will not lose its ground reference and cause the compressor to start before probe 23B becomes exposed in the water in the normal manner.

It should be understood with reference to the operation of the ice detector, that when the compressor C shuts OFF, the ice adjacent the tank walls begins to melt. Within a few moments after compressor shut-off a film of water develops around tank 18 between the tank walls and ice 70. Thus, the condition of the ice or degree of freezing is automatically controlled by probes 23 via electronic controller EC. Accordingly, the ice bank thickness within tank 18 is also automatically controlled within predetermined limits.

As stated hereinbefore electronic controller EC also receives signals along lines R1, R2 from reed switches RSC, RSW which indicate the beginning of a dispensing step. Electronic controller EC receives these signals and energizes agitator motor 41 in response thereto. Controller EC has an electronic time delay means incorporated therein which turns agitator motor 41 OFF approximately 1 to 3 minutes after the end of a dispensing cycle. Thus, the agitator assembly runs only intermittently in synchronism with commencement of the dispensing cycle. This intermittent operation helps to prevent freeze-ups in tank 18.

It should be understood that the time delay means in the electronic controller may be triggered either by the beginning or end of the dispensing cycle, i.e. the closing or opening of reed switches RSC, RSW. The important thing is to choose a time delay which continues rotation of the agitator for a predetermined time after the dispensing valves are shut down. Accordingly, either the beginning or end of the dispensing cycle can be used as a reference provided a time delay of sufficient duration is chosen.

Referring in detail to FIG. 2 there is illustrated an enlarged view of the agitator motor 41 of FIG. 1B and the manner in which it is coupled to the bottom of tank 18. As shown motor 41 is disposed within a mounting bracket 85. Mounting bracket 85 in a preferred embodiment is aluminum and is affixed to the bottom of tank 18. The aluminum bracket 85 functions to conduct heat from the motor to the tank 18. There is also provided a cover 86 surrounding the motor 41 and hermetically sealing the same to prevent condensate damage thereto. The motor mounting assembly illustrated in FIG. 2 tends to prolong the life of motor 41.

DESCRIPTION OF SYSTEM OPERATION

The dispensing operation begins with the actuation of either lever LC or LW when an operator presses a cup against the same. Syrup then begins to flow out of tanks 3 through aperture 12 and the dispensing valves. Simultaneously, either carbonated water or sweet water flows from carbonator 30 to the dispensing valves. When the carbonated or sweet water starts to flow reed switches RSC and RSW are closed sending momentary signals to electronic controller EC. Controller EC starts agitator motor 41 in response to the signals from the reed switches. A time delay realy in controller EC maintains the operation of motor 41 for 1 to 3 minutes after the dispensing valves are closed and then cuts the motor OFF. Thus, the agitator continues to run for a predetermined period of time after the dispensing cycle ends.

The agitator, as discussed hereinbefore, both carbonates and cools the water in tank 18 during its operation. The intermittent operation thereof controlled by controller EC helps preclude freeze-ups in tank 18.

During the entire operation described above probes 22 continuously monitor and control the water level in tank 18 and probes 23 continuously monitor and control the ice bank thickness in tank 18 in the manner discussed hereinbefore.

It should be understood that the system described herein may be modified as would occur to one of ordinary skill in the art without departing from the spirit and scope of the present invention.

What is claimed is:

1. An apparatus for dispensing cool beverages comprising in combination:
   - dispensing valve means for dispensing said cool beverages when said valve means is open;
   - receptacle means containing a flavor concentrate to be supplied to said dispensing valve means;
   - closed tank means for storing water to be supplied to said dispensing valve means;
   - means for cooling said water in said tank means;
   - agitator means for circulating said water in said storage tank in response to the energization thereof; and
   - means for intermittently energizing said agitator means, including control means for sensing the opening of said dispensing valve means and energizing said agitator means in response thereto and time delay means for de-energizing said agitator means a predetermined period of time after the closing of said dispenser valve means;
   - whereby freeze-ups in said storage tank are substantially precluded.

2. The apparatus of claim 1 wherein there is further provided means for supplying carbon dioxide gas to said water in said tank means to carbonate the water contained therein.

3. The apparatus of claim 1 further including conduit means extending through the water stored in said tank in a heat exchanging relationship therewith and means for passing sweet water through said conduit means to said dispensing valve means, whereby the sweet water is cooled by the water stored in said tank means.

4. The apparatus of claim 1 further including means for automatically controlling the level of said water in said tank means.

5. The apparatus of claim 1 wherein said means for cooling comprises:
   - coil means adjacent the walls of said tank means;
   - compressor means for circulating cooling fluid through said coil means in response to a first control signal and for stopping the circulation of said cooling fluid in response to a second control signal;
   - control circuit means for generating said first and second control signals; and
   - ice detecting means in said tank means coupled to said control circuit means for monitoring the quantity of ice formed within said tank means, said detecting means causing said control circuit means to generate said first control signal when said ice is less than a first predetermined quantity and to generate said second control signal when said ice exceeds a second predetermined quantity.

6. The apparatus of claim 5 wherein said tank is connected to ground potential and a third electrical probe means is provided for coupling said ice bank to said tank wall, whereby said ice bank is maintained at ground potential.

7. The apparatus of claim 1 wherein said tank means includes inlet and outlet couplings for supplying water to and from said tank means and there is further provided heater means adjacent each inlet and outlet couplings for precluding freeze-ups at said couplings.

8. The apparatus of claim 7 wherein means are provided for energizing said heater means in synchronism with the energization of said means for cooling.

9. The apparatus of claim 1 wherein heat transfer coupling means are provided between said receptacle means and said cooling means;
   - whereby said flavor concentrate is cooled by the same cooling means as the water in said tank.

10. The apparatus of claim 1 wherein means are provided for energizing said heater means in synchronism with the energization of said means for cooling.

11. An apparatus for dispensing cool beverages comprising in combination:
   - dispensing valve means for dispensing said cool beverages when said valve means is open;
   - receptacle means containing a flavor concentrate to be supplied to said dispensing valve means;
   - closed tank means for storing water to be supplied to said dispensing valve means;
   - means for cooling said water in said tank means, wherein said means for cooling comprises:
   - coil means adjacent to walls of said tank means;
   - compressor means for circulating cooling fluid through said coil means in response to a first control signal and for stopping the circulation of said cooling fluid in response to a second control signal;
   - control circuit means for generating said first and second control signals; and
   - ice detecting means in said tank means coupled to said control circuit means for monitoring the quantity of ice formed within said tank means, said detecting means causing said control circuit means to generate said first control signal when said ice is less than a first predetermined quantity and to generate said second control signal when said ice exceeds a second predetermined quantity, and further wherein said means for cooling facilitates the formation of an ice bank adjacent the side walls of said tank means and said ice detecting means comprises:

first electrical probe means disposed within said ice bank and spaced at a first predetermined distance from said tank walls, said first electrical probe means functioning with said control circuit means to generate said first control signal when the space between said first probe means and said tank walls is filled with ice; and second electrical probe means disposed within said ice bank and spaced at a second predetermined distance from said tank walls, said second electrical probe means functioning with said control circuit means to generate said second control signal when the space between said second probe means and said tank walls is not filled with ice;

agitator means for circulating said water in said storage tank in response to the energization thereof; and means for intermittently energizing said agitator means;

whereby freeze-ups in said storage tank are substantially precluded.

12. The apparatus of claim 11 wherein said tank is connected to ground potential and a third electrical probe means is provided for coupling said ice bank to said tank wall, whereby said ice bank is maintained at ground potential.

13. An apparatus for dispensing cool beverages comprising in combination:

dispensing valve means for dispensing said cool beverages when said valve means is open;

receptacle means containing a flavor concentrate to be supplied to said dispensing valve means;

closed tank means for storing water to be supplied to said dispensing valve means;

means for cooling said water in said tank means and wherein heat transfer coupling means are provided between said receptacle means and said cooling means;

whereby said flavor concentrate is cooled by the same cooling means as the water in said tank;

and further wherein said receptacle means comprises:

an outer container of heat conducting metal; and a plastic inner container disposed within said outer container in direct contact with the bottom but spaced from the side walls thereof, the flavor concentrate being disposed in the inner container;

agitator means for circulating said water in said storage tank in response to the energization thereof; and means for intermittently energizing said agitator means;

whereby freeze-ups in said storage tank are substantially precluded.

14. An apparatus for dispensing cool beverages comprising in combination:

dispensing valve means for dispensing said cool beverages when said valve means is open;

receptacle means containing a flavor concentrate to be supplied to said dispensing valve means;

closed tank means for storing water to be supplied to said dispensing valve means;

coil means adjacent the walls of said tank means;

compressor means for circulating cooling fluid through said coil means in response to a first control signal and for stopping the circulation of said cooling fluid in response to a second control signal;

control circuit means for generating said first and second control signals; and ice detecting means in said tank means coupled to said control circuit means for monitoring the quantity of ice formed within said tank means, said detecting means causing said control circuit means to generate said first control signal when said ice is less than a first predetermined quantity and to generate said second control signal when said ice exceeds a second predetermined quantity;

and wherein said means for cooling facilitates the formation of an ice bank adjacent the interior side walls of said tank means and said ice detecting means comprises:

first electrical probe means disposed within said ice bank and spaced at a first predetermined distance from said tank walls, said first electrical probe means functioning with said control circuit means to generate said first control signal when the space between first probe means and said tank walls is filled with ice; and second electrical probe means disposed within said ice bank and spaced at a second predetermined distance from said tank walls, said second electrical probe means functioning with said control circuit means to generate said second control signal when the space between said second probe means and said tank walls is not filled with ice.

* * * * *